US006213560B1

(12) United States Patent
Lindblom

(10) Patent No.: US 6,213,560 B1
(45) Date of Patent: Apr. 10, 2001

(54) VARIABLE WIDTH MILLING DRUM

(75) Inventor: Victor E. Lindblom, Brooklyn Center, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 0 days.

(21) Appl. No.: 09/311,541

(22) Filed: May 13, 1999

Related U.S. Application Data

(60) Provisional application No. 60/125,133, filed on Mar. 19, 1999.

(51) Int. Cl.[7] ..... F01C 23/088
(52) U.S. Cl. ..... 299/39.4; 404/90
(58) Field of Search ..... 299/39.4, 39.8; 404/90

(56) References Cited

U.S. PATENT DOCUMENTS

| | | | |
|---|---|---|---|
| 1,269,098 | 6/1918 | Latta . | |
| 2,090,290 | 8/1937 | Gardner | 94/44 |
| 2,754,734 | 7/1956 | Gardner | 94/50 |
| 2,895,390 | 7/1959 | Gardner | 94/50 |
| 4,139,318 | 2/1979 | Jakob et al. | 404/90 |
| 4,186,968 | 2/1980 | Barton | 299/39 |
| 4,193,636 | 3/1980 | Jakob | 299/39 |
| 4,242,020 | 12/1980 | Schmid | 409/234 |
| 4,473,320 | 9/1984 | Register | 404/91 |
| 4,489,985 | 12/1984 | Kendrick | 299/80 |
| 4,512,612 | 4/1985 | Allard | 299/91 |
| 4,704,045 | 11/1987 | Taylor et al. | 404/90 |
| 4,720,207 | 1/1988 | Salani | 404/90 |
| 4,723,867 | 2/1988 | Wirtgen | 404/90 |
| 4,755,001 | 7/1988 | Gilbert | 299/39 |
| 4,904,024 | 2/1990 | Wiley | 299/39 |
| 5,083,839 | 1/1992 | Younger | 299/89 |
| 5,120,112 | 6/1992 | Kincaid | 299/67 |
| 5,190,398 | 3/1993 | Swisher, Jr. | 404/90 |
| 5,474,397 | 12/1995 | Lyons | 299/39.5 |
| 5,505,598 | 4/1996 | Murray | 404/90 |
| 5,511,901 | 4/1996 | Yates | 404/124 |
| 5,536,073 | 7/1996 | Sulosky et al. | 299/39.8 |
| 5,582,490 | 12/1996 | Murray | 404/90 |
| 5,695,256 | 12/1997 | Kishimoto | 299/39.2 |
| 5,722,789 | 3/1998 | Murray et al. | 404/90 |

FOREIGN PATENT DOCUMENTS 5-9909 1/1993 (JP) .

OTHER PUBLICATIONS

CMI Corporation's Variable–Width Cutters for Roto–Miller PR–800–7, PR–650, and PR–500B Pavement Profilers Pamphlet, CMI–3782 Feb. 1994.

Pamphlet entitled, "The Caterpiller PM–565 Segmented Drum is Designed for the Work You Do," Nov., 1996.

*Primary Examiner*—William Neuder
(74) *Attorney, Agent, or Firm*—Maginot, Addison & Moore; Jeff A. Greene

(57) ABSTRACT

A variable-width milling drum assembly includes a milling drum having an outer surface. The assembly also includes a plurality of cutting segments removably secured to the outer surface of the milling drum along a first substantially helical axis. Each of the plurality of cutting segments includes a segment flight member. Each segment flight member is positioned in helical alignment with respect to an adjacent segment flight member. The assembly also includes a kicker plate which is secured to the substantially cylindrical outer surface along a second helical axis. The kicker plate is utilized to move cut material in a direction away from the cutting segments during rotation of the milling drum. A method of varying the cutting width of a variable-width milling drum assembly is also disclosed.

27 Claims, 9 Drawing Sheets

VARIABLE WIDTH MILLING DRUM

This application claims the benefit of U.S. Provisional Application Ser. No. 60/125,133, filed Mar. 19, 1999.

TECHNICAL FIELD OF THE INVENTION

The present invention relates generally to a milling drum, and more particular to an apparatus and method for varying the cutting width of a variable-width milling drum.

BACKGROUND OF THE INVENTION

A milling machine is a type of work machine which is utilized to mill asphalt, concrete, or other types of road materials such that a worn road surface may be removed and subsequently replaced with a new road surface. Such milling machines typically include a milling drum which has a number of cutting teeth secured thereto. Rotation of the drum causes the cutting teeth to mill or otherwise cut the material associated with the worn road surface. The cut material is then advanced by the milling drum to a conveyor system associated with the milling machine in order to convey or otherwise transport the cut road material to a dump truck or the like for removal from the work site.

During operation of the milling machine, it is often necessary to perform cuts of varying widths. For example, the milling machine may be required to cut a section of asphalt having a width of two feet at a first work site, and thereafter be required to cut a section of asphalt having a width of three feet at a second work site. Such a requirement to perform cuts of varying widths has been particularly difficult for certain milling machines which have heretofore been designed. In particular, in order to change the cutting width of certain heretofore designed milling machines, the entire milling drum must be removed from the machine and thereafter replaced with a second milling drum having the desired cutting width. Such an exchange of the entire milling drum is extremely time consuming and labor intensive thereby potentially resulting in extended downtime of the milling machine.

In order to eliminate the need to exchange the entire milling drum when it is desirable for a change of cutting width, milling drums have heretofore been designed with removable cutting sections or segments. The cutting segments may be selectively added or removed from the milling drum in order to change the cutting width of the milling drum thereby eliminating the need to remove the entire milling drum from the milling machine. However, heretofore designed segmented milling drums have a number of drawbacks associated therewith. For example, segmented milling drums which have heretofore been designed typically include a complex mounting assembly for mounting each of the cutting segments to an outer surface of the milling drum which contains a relatively large number of components. In addition, such mounting assemblies also require a number of complex mounting features to be machined or otherwise fabricated on the outer surface of the milling drum. Moreover, the cutting segments associated with segmented milling drums which have heretofore been designed are relatively large, bulky objects which weigh as much as several hundred pounds apiece thereby requiring a plurality of technicians to install or remove the cutting segments to/from the milling drum. In addition, heretofore designed segmented milling drums typically require unique milling chambers and drive assemblies thereby increasing the complexity associated with retrofit of the segmented milling drum into an existing milling machine design. What is needed therefore is a segmented milling drum assembly which overcomes one or more of the above-mentioned drawbacks.

DISCLOSURE OF THE INVENTION

In accordance with a first embodiment of the present invention, there is provided a variable-width milling drum assembly. The assembly includes a milling drum having an outer surface. The assembly also includes a plurality of cutting segments removably secured to the outer surface of the milling drum along a first substantially helical axis. Each of the plurality of cutting segments includes a segment flight member. Each segment flight member is positioned in helical alignment with respect to an adjacent segment flight member.

In accordance with a second embodiment of the present invention, there is provided a method of varying cutting width of a variable-width milling drum assembly. The method includes the step of providing a milling drum having an outer surface. The method also includes the step of providing a plurality of cutting segments, wherein each of the plurality of cutting segments includes a segment flight member. The method also includes the step of securing a first set of the plurality of cutting segments to the outer surface of the milling drum along a first substantially helical axis so as to define a first cutting width. Each segment flight member of the first set of the plurality of cutting segments is positioned in helical alignment with respect to an adjacent segment flight member when the first set of the plurality of cutting segments is secured to the outer surface of the milling drum.

BEST MODE FOR CARRYING OUT THE INVENTION

Figure 1:
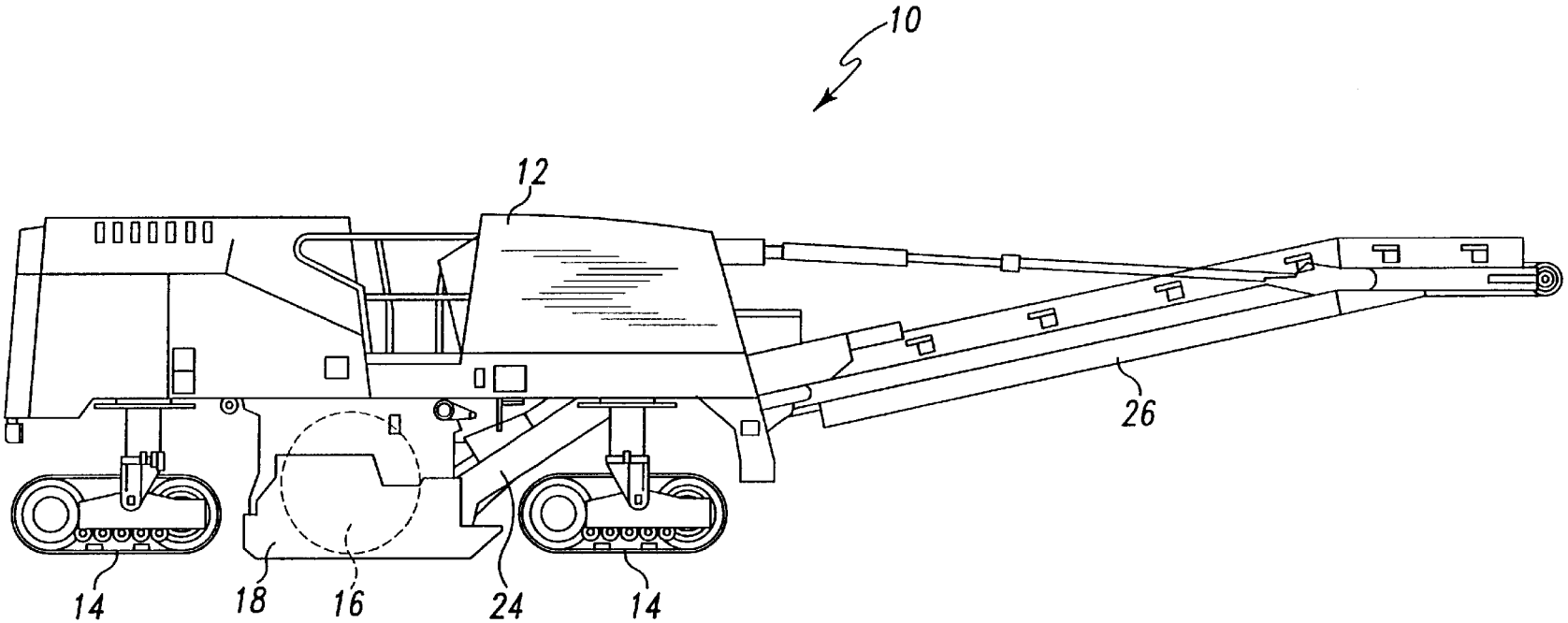
FIG. 1 is a side elevation view of a milling machine which incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Figure 2:
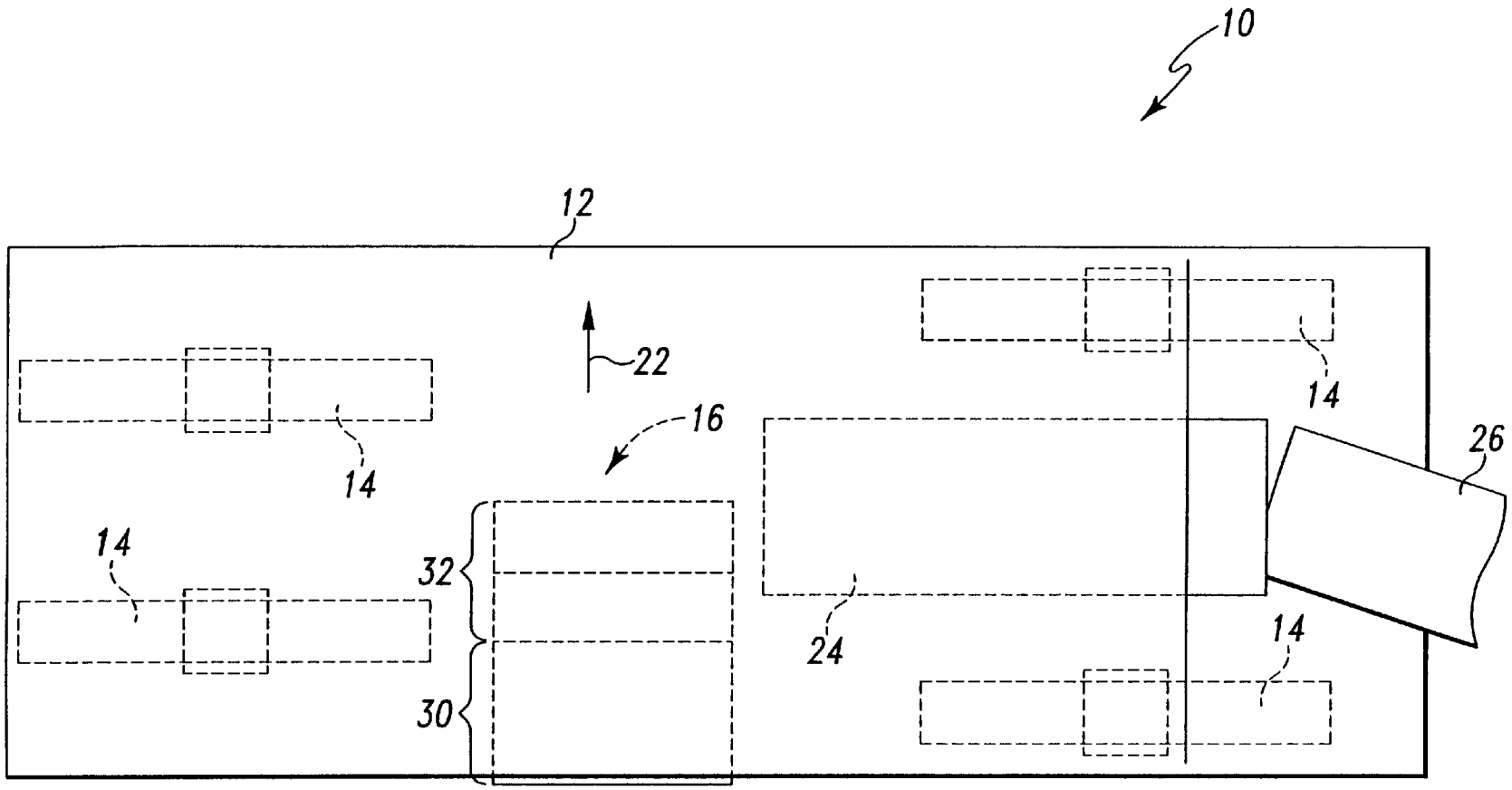
FIG. 2 is a top diagrammatic view of the milling machine of FIG. 1.

Referring now to FIGS. 1 and 2, there is shown a work machine such as a milling machine 10. The milling machine 10 is utilized to perform numerous work functions such as the milling or cutting and removal of various construction materials such as asphalt, cement, or other road surface materials. The milling machine 10 includes a body 12 and a number of drive track assemblies 14. The drive track assemblies 14 are hydraulically driven and provide the motive power for moving the milling machine 10.

The milling machine 10 also includes a segmented milling drum assembly 16 which is housed in a cutting chamber 18. During rotation of the segmented milling drum assembly 16, a number of cutting teeth 20 (see FIG. 3) engage a surface to be removed such as a worn roadway in order to mill or otherwise cut the material into relatively small pieces. The pieces of cut material are then advanced by the rotating segmented milling drum assembly 16 in the general direction of arrow 22 of FIG. 2 toward the input of a lower conveyor 24. The lower conveyor 24 conveys the cut material into the input of a discharge conveyor 26. The discharge conveyor 26 in turn conveys the cut material to a dump truck or the like (not shown) for removal from the work site.

Referring now to FIGS. 3–6, there is shown the segmented milling drum assembly 16 in greater detail. The segmented milling drum assembly 16 includes a milling drum 28 having a stationary cutting section 30 and a segmented cutting section 32. The stationary cutting section 30 includes a stationary cutting flight 34 which is welded or otherwise secured to a substantially cylindrical outer surface 36 of the milling drum 28 along a first substantially helical axis. The stationary cutting flight 34 has a number of tooth holders 38 secured thereto. One of the cutting teeth 20 is secured to each of the tooth holders 38. Rotation of the segmented milling drum assembly 16 causes the cutting teeth 20 to engage the roadway or other surface being milled by the milling machine 10 thereby allowing the teeth 20 to cut the material associated with the roadway.

Figure 4:
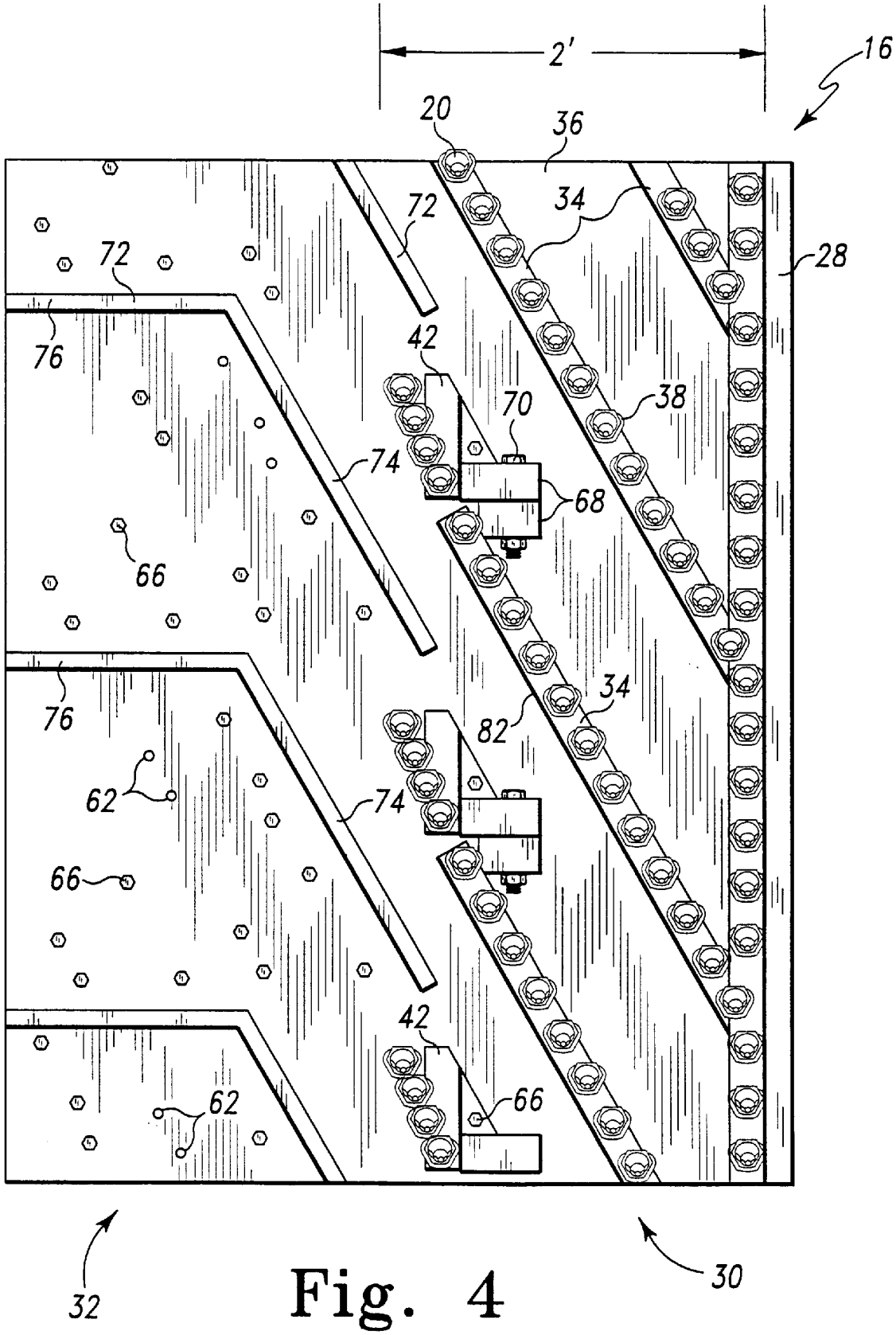
FIG. 4 is a development view of the segmented milling drum assembly of FIG. 3 which shows the segmented milling drum assembly configured to perform a cut having a width of two feet.
Figure 5:
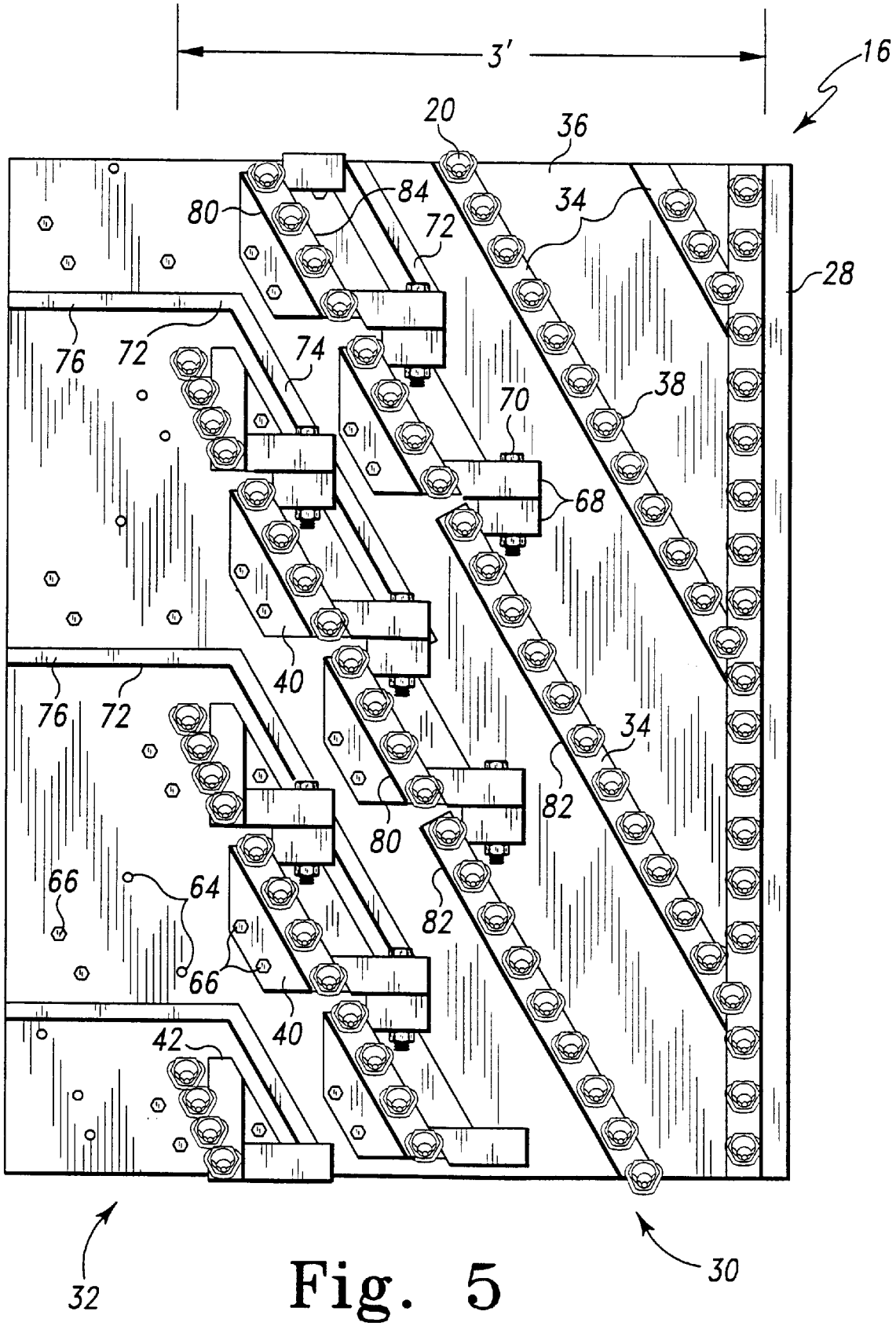
FIG. 5 is a view similar to FIG. 4, but showing the segmented milling drum assembly configured to perform a cut having a width of three feet.
Figure 6:
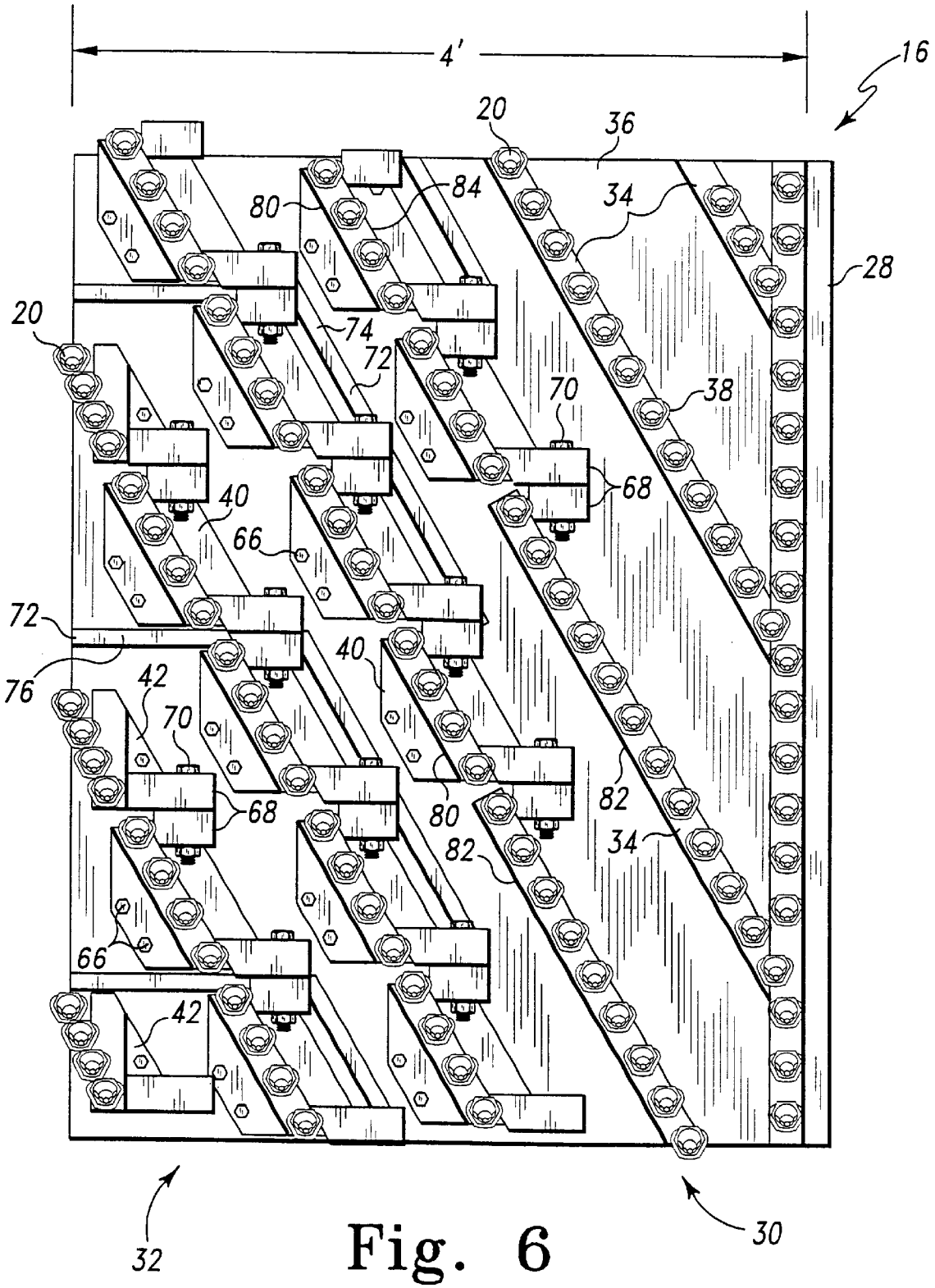
FIG. 6 is a is a view similar to FIG. 4, but showing the segmented milling drum assembly configured to perform a cut having a width of four feet.

The segmented milling drum assembly 16 is a variable-width segmented milling drum assembly. In particular, the segmented milling drum assembly 16 may be utilized to create cuts in a roadway of varying widths. For example, as shown in FIG. 4, the cutting teeth 20 located on the stationary flight 34 of the milling drum 28 may be utilized to create a cut which has a width of two feet in a roadway or the like. Alternatively, as shown in FIG. 5, a number of main cutting segments 40 and end cutting segments 42 may be secured to the cylindrically outer surface 36 of the segmented milling drum 28 along the same helical axis as the stationary cutting flights 34 in order to increase the cutting width of the segmented milling drum assembly 16 to three feet. Moreover, as shown in FIG. 6, additional main cutting segments 40 and end cutting segments 42 may be secured to the cylindrical outer surface 36 of the segmented milling drum 28 along the same helical axis as the stationary cutting flight 34 in order to increase the cutting width of the segmented milling drum assembly 16 to four feet.

Figure 7C:
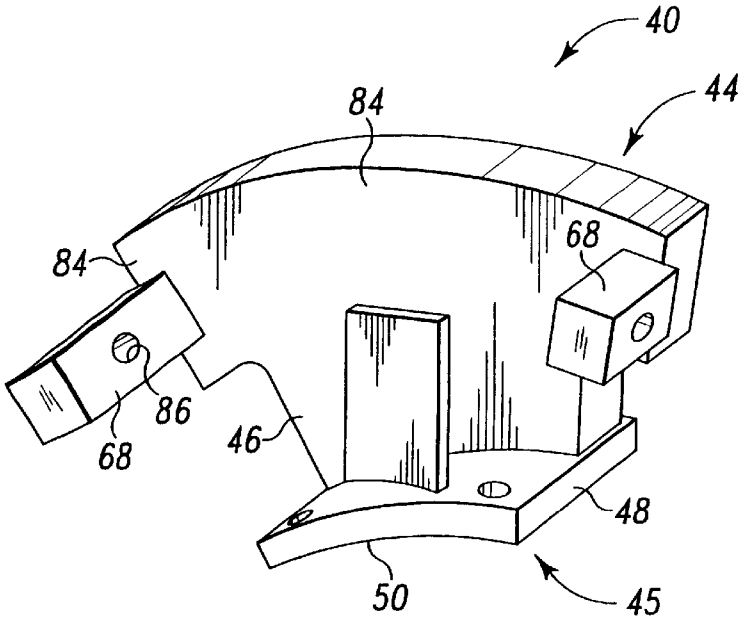
FIGS. 7A–7C show various views of a main cutting segment of the segmented milling drum assembly of FIG. 3, note that in FIGS. 7B and 7C the tooth holders and the cutting teeth have been removed for clarity of description.
Figure 7A:
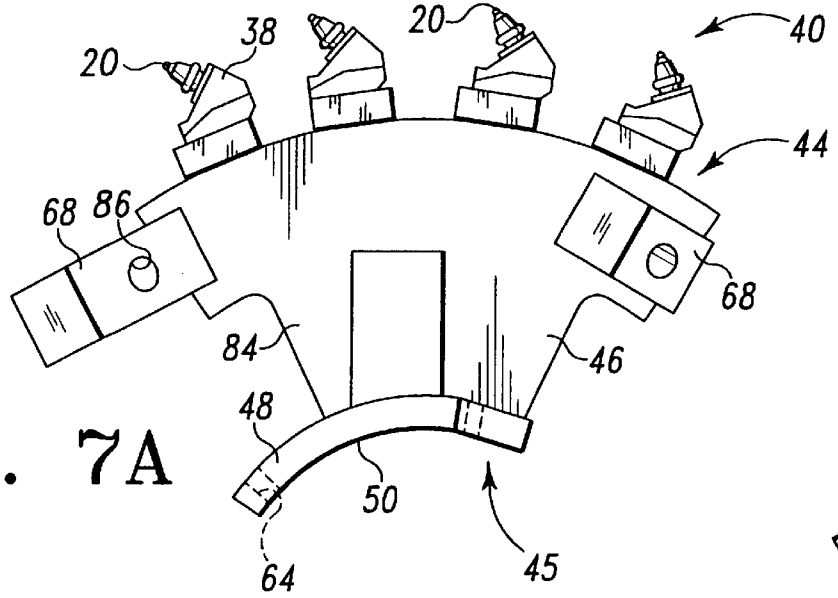
Figure 7B:
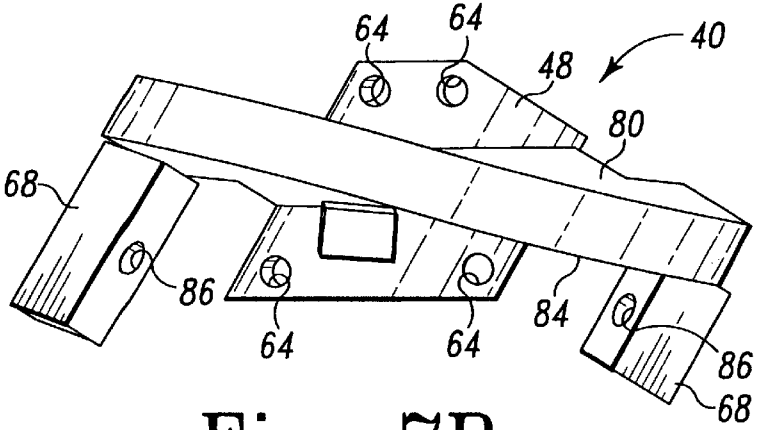

As shown in FIGS. 7A–7C, each of the main cutting segments 40 has a curved outer end 44 and a curved inner end 45. In particular, the main cutting segment 40 includes a flight member 46 having a curved mounting plate 48 secured to an end thereof. Preferably, the mounting plate 48 is welded to the inner end of the flight member 46, as shown in FIG. 7A. An inner surface 50 of the curved mounting plate 48 defines the curved inner end 45 of the main cutting segment 40. The curved outer end 44 of the main cutting segment 40 has a number of the cutting teeth 20 secured thereto. In particular, a number of the tooth holders 38 are welded or otherwise secured to an outer end of the flight member 46 (see FIG. 7A), with each of the tooth holders 38 having a cutting tooth 20 positioned therein.

Figure 8B:
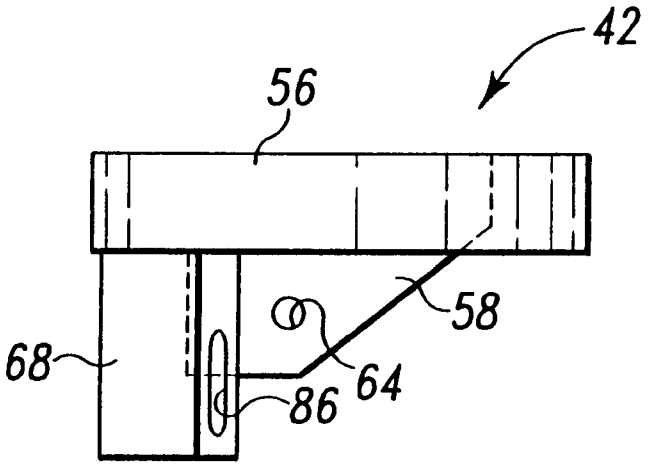
FIGS. 8A–8B show various views of an end cutting segment of the segmented milling drum assembly of FIG. 3, note that in FIG. 8B the tooth holders and the cutting teeth have been removed for clarity of description.
Figure 8A:
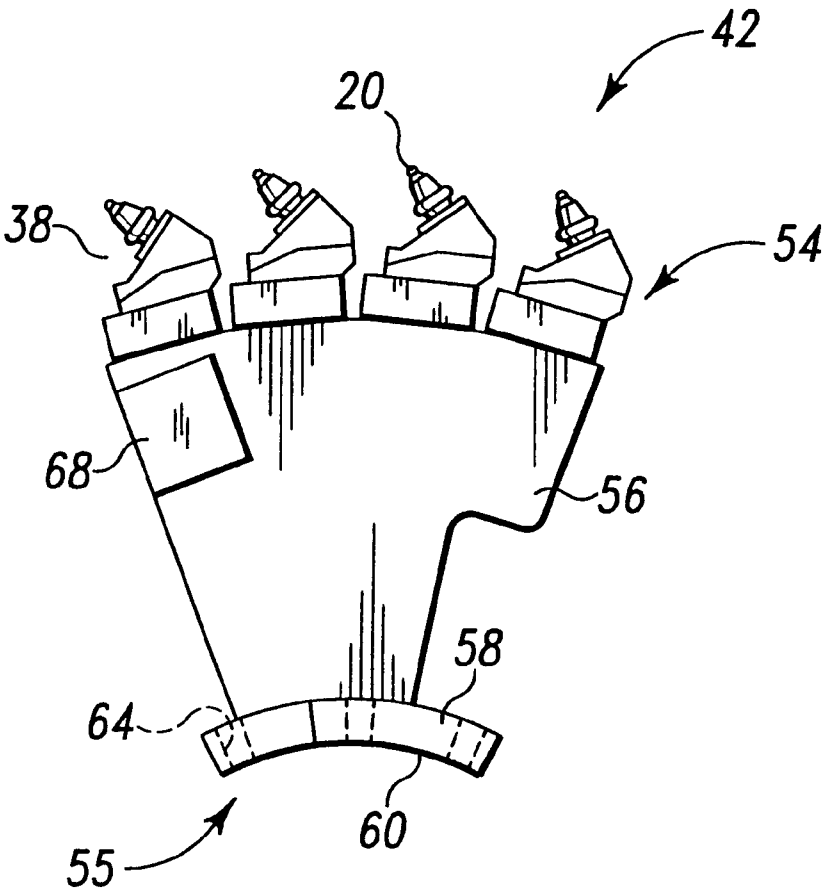

Similarly, as shown in FIGS. 8A–8B, each of the end cutting segments 42 has a curved outer end 54 and a curved inner end 55. In particular, the end cutting segment 42 includes a flight member 56 having a curved mounting plate 58 secured to an end thereof. Preferably, the mounting plate 58 is welded to the inner end of the flight member 56, as shown in FIG. 8A. An inner surface 60 of the curved mounting plate 58 defines the curved inner end 55 of the end cutting segment 42. The curved outer end 54 of the end cutting segment 42 has a number of the cutting teeth 20 secured thereto. In particular, a number of the tooth holders 38 are welded or otherwise secured to an outer end of the flight member 56 (see FIG. 8A), with each of the tooth holders 38 having a cutting tooth 20 positioned therein.

As alluded to above, a number of the main cutting segments 40 and the end cutting segments 42 may be secured to the milling drum 28 in order to change the cutting width of the drum 28. In particular, the cylindrical outer surface 36 of the milling drum 28 has a number of fastening apertures 62 defined therein, whereas the curved mounting plates 48, 58 of the cutting segments 40, 42, respectively, have a number of fastening apertures 64 defined therein (see FIGS. 7A–7C and 8A–8B). In order to secure one of the main cutting segments 40 to the milling drum 28 (see FIGS. 5 and 6), the curved mounting plate 48 is first positioned in contact with the milling drum 28 such that the curved inner surface 50 of the mounting plate 48 substantially conforms to the cylindrical outer surface 36 of the milling drum 28. Thereafter, the fastening apertures 64 of the mounting plate 48 are aligned with the fastening apertures 62 defined in the cylindrical outer surface 36 of the milling drum 28. Once aligned, a number of fasteners such as bolts 66 are then threadingly engaged in the fastening apertures 62, 64 so as to secure the main cutting segment 40 to the milling drum 28.

Similarly, in order to secure one of the end cutting segments 42 to the milling drum 28 (see FIGS. 4–6), the curved mounting plate 58 is first positioned in contact with the milling drum 28 such that the curved inner surface 60 of the mounting plate 58 substantially conforms to the cylindrical outer surface 36 of the milling drum 28. Thereafter, the fastening apertures 64 of the mounting plate 58 are aligned with the fastening apertures 62 defined in the cylindrical outer surface 36 of the milling drum 28. Once aligned, a number of the bolts 66 are then threadingly engaged in the fastening apertures 62, 64 so as to secure the end cutting segment 42 to the milling drum 28.

Figure 9:
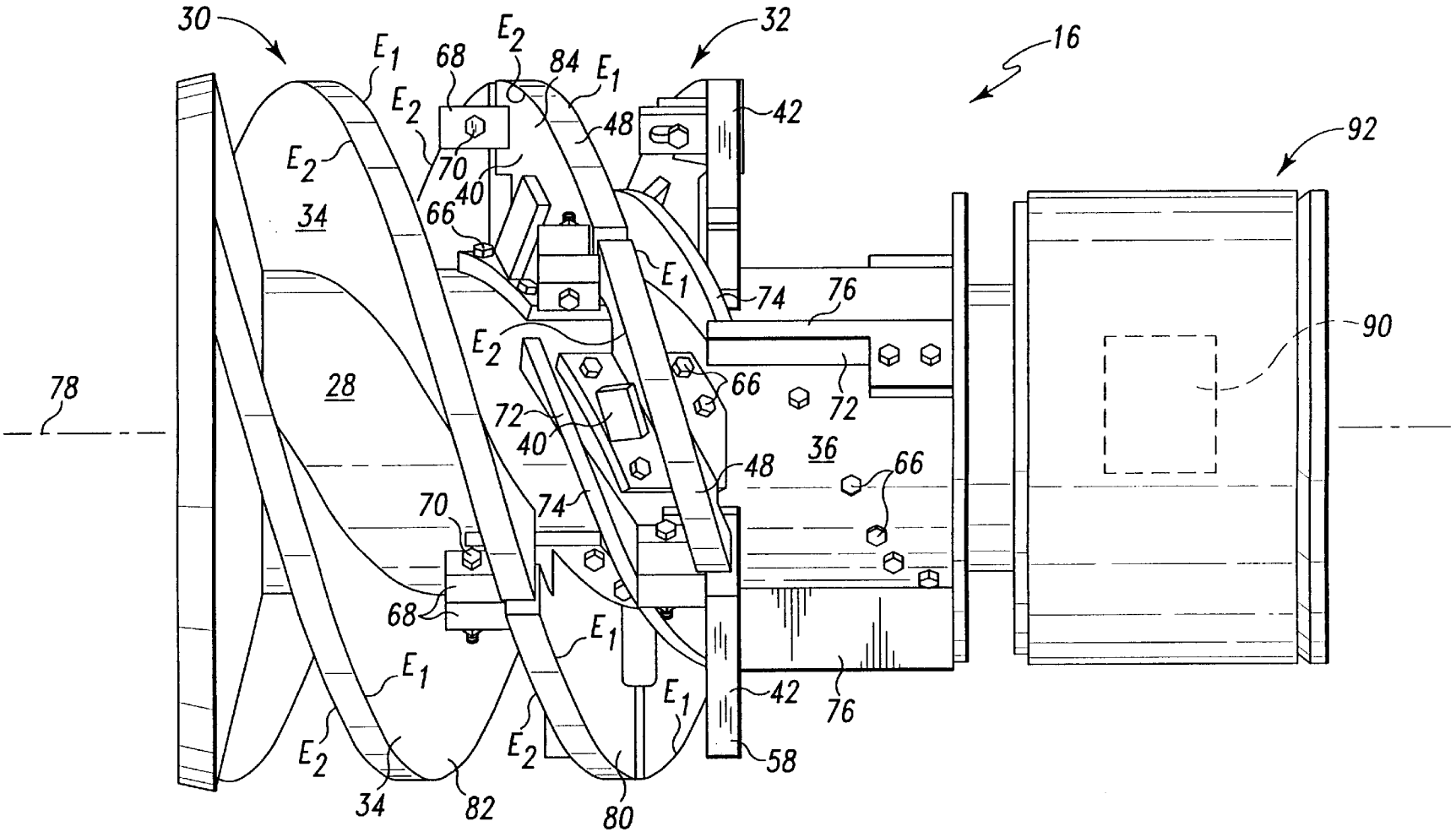
FIG. 9 is an elevational view of the segmented milling drum assembly of FIG. 3 which shows the segmented milling drum assembly configured to perform a cut having a width of three feet, note that the tooth holders and the cutting teeth have been removed from the stationary cutting flight and the cutting segments for clarity of description.

As shown in FIG. 9, the stationary cutting flight 34 and the flight members 46, 56 are secured to the cylindrical outer surface 36 of the milling drum 28 in helical alignment with one another. What is meant herein by the term "helical alignment" is that both a first edge ($E_1$) and a second edge ($E_2$) of adjacent components define a first helical line and a second helical line, respectively. For example, as shown in FIG. 9, the first edge $E_1$ of the stationary cutting flight 34 and the first edge $E_1$ of the flight member 46 of the adjacent main cutting segment 40 define a first helical line. Moreover, the second edge $E_2$ of the stationary cutting flight 34 and the second edge $E_2$ of the flight member 46 of the adjacent main cutting segment 40 define a second helical line. Similarly, the first edge $E_1$ and the second edge $E_2$ of the flight members 46 of adjacent main cutting segments 40 define respective helical lines.

As shown in FIGS. 7C and 9, helical alignment of the main cutting segments 40 is accomplished by forming, twisting, or otherwise fabricating a "twist" into the flight member 46 of each main cutting segment 40. Such a twist enables the ends of the main cutting segments 40 to abut against either the end of the stationary cutting flight 34 or the end of an adjacent cutting segment. The mounting arrangement of the main cutting segments 40 in which the cutting segments 40 are mounted in helical alignment with one another (and the stationary cutting flight 34) is contrasted from heretofore designed mounting arrangements in which cutting segments are mounted in a jagged, "step-like" arrangement on the face of the milling drum.

It should be appreciated that the mounting configuration of the cutting segments 40, 42 provides a number of advantages over segmented milling drums which have heretofore been designed. For example, by utilizing a curved mounting structure (i.e. the curved mounting plates 48, 58) which substantially conforms to the cylindrical outer surface 36 of the milling drum 28, the milling drum 28 does not have to be machined or otherwise constructed to include mounting structures such as flat surfaces or stand-offs thereby reducing costs associated with manufacture of the segmented milling drum assembly 16. Moreover, the use of cutting segments 40, 42 secured along a helical axis allows the cutting segments 40, 42 to be configured as relatively small components which typically have a weight of less than 130 pounds. Such relatively light cutting segments 40, 42 facilitate installation or removal thereof by a single technician.

Moreover, by securing the main cutting segments 40 in helical alignment with one another and the main cutting flight 34, an efficient material movement system is created. In particular, by abutting the ends of the cutting segments 40, 42 to the end of an adjacent cutting segment 40 or the end of the stationary cutting flight 34 (see FIG. 9), a front face 80 defined in the flight members 46, 56 of each of the cutting segments 40, 42, respectively, cooperates with a front face 82 of the stationary cutting flight 34 to define a substantially continuous surface along which cut material is advanced during rotation of the segmented milling drum assembly 16. It should be appreciated that such a continuous surface provides significant material handling advantages over heretofore designed milling drum assemblies which have cutting segments that are mounted in a jagged, "step-like" arrangement on the face of the milling drum.

As shown in FIGS. 4 and 5, the fastening apertures 62 defined in the cylindrical outer surface 36 of the milling drum 28 which are not being utilized to secure one of the cutting segments 40, 42 to the milling drum 28 preferably have a protecting device such as one of the bolts 66 positioned therein. It should be appreciated that such use of the bolts 66 in the fastening apertures 62 which are not being utilized to secure the cutting segments 40, 42 to the milling drum 28 prevents damage to the threads of the fastening apertures 62 due to contact with cut material or other debris.

As shown in FIGS. 4–6, 7B, 7C, and 8B, each of the cutting segments 40, 42 and the stationary cutting flights 34 includes a number of coupling blocks 68. The coupling blocks 68 are secured to a rear face 84 of the flight members 46, 56. The coupling blocks 68 are provided to couple the cutting segments 40, 42 to one another along with the stationary cutting flight 34 thereby increasing the structural rigidity of the segmented milling drum assembly 10. In particular, a nut and bolt assembly 70 is received into apertures 86 defined in each of the coupling blocks 68 thereby securing the coupling blocks 68 of adjacent cutting segments 40, 42 to one another. Similarly, one of the nut and bolt assemblies 70 is utilized to secure the coupling block 68 of one of the cutting segments 40, 42 to the coupling block 68 positioned on the end of each of the stationary cutting flights 34. It should be appreciated that by securing the coupling blocks 68 to the rear face 84 of the flight members 46, 56, the coupling blocks 68 do not interfere with the advancement of cut material toward the lower conveyor 24 during rotation of the milling drum 28 since the cut material is being advanced along the front face 80 of the cutting segments 40, 42.

The segmented milling drum assembly 16 also includes a number of kicker plates 72 (see FIGS. 3–6) which are welded or otherwise secured to the cylindrical outer surface 36 of the milling drum 28. The kicker plates 72 are provided to advance cut material across the portions of the milling drum 28 which are devoid of the cutting segments 40, 42 and the stationary cutting flight 34. In particular, the kicker plates 72 advance cut material away from the cutting teeth 20 of the cutting segments 40, 42 and the stationary cutting flight 34 in a direction toward the input of a lower conveyor 24 during rotation of the segmented milling drum assembly 16 (i.e. in the general direction of arrow 22 of FIG. 2). As described above, the lower conveyor 24 conveys the cut material toward the input of the discharge conveyor 26. In order to move the cut material in the manner described, the kicker plates 72 are configured to include a lateral movement portion 74 for advancing the cut material laterally toward the lower conveyor 24 and a lift portion 76 for lifting the cut material into the input of the conveyor 24.

Figure 3:
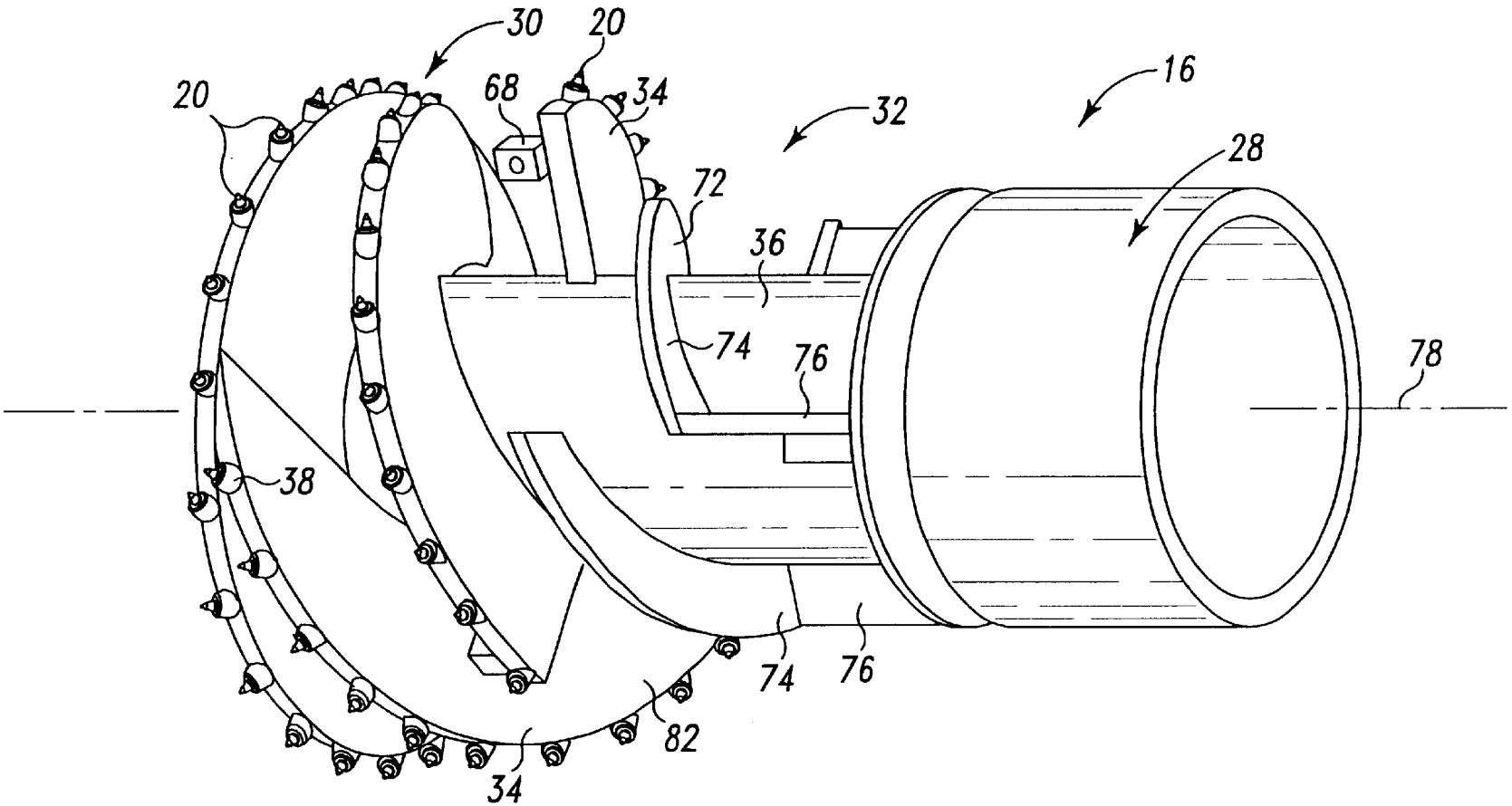
FIG. 3 is a perspective view of a segmented milling drum assembly of the milling machine of FIG. 1.

As shown in FIGS. 3 and 4, the lateral movement portion 74 of the kicker plates 72 is angled relative to a central axis of rotation 78 of the milling drum 28. What is meant herein by the phrase "angled relative to the central axis of rotation of the milling drum" is that the lateral movement portion 74 of the kicker plates 72 is secured to the milling drum in an orientation which is not parallel to the central axis of rotation 78 of the milling drum 28. For example, the lateral movement portion 74 of each of the kicker plates 72 is preferably secured to the cylindrical outer surface 36 of the milling drum 28 along a helical axis which is substantially parallel to the stationary cutting flight 34, as shown in FIG. 3.

As shown in FIGS. 3–6, the lift portion 76 of each of the kicker plates 72 is secured to the milling drum 28 in an orientation which is substantially parallel to the central axis 78 of rotation of the milling drum 28. Such an orientation facilitates lifting of cut material into the input of the lower conveyor 24 during rotation of the milling drum 28.

As shown in FIG. 9, the segmented milling drum assembly 16 has a gear reducing assembly 90 disposed in an inboard end 92 of the milling drum 28 which is opposite to the end of the milling drum 28 at which the stationary cutting flight 34 is secured. The gear reducing assembly 90 is driven by a belt drive (not shown) associated with the milling machine 10 so as to rotate the milling drum 28 during operation of the milling machine 10. It should be appreciated that such a configuration has numerous advantages over heretofore designed segmented milling drum assemblies. For example, the gear reducing assembly of a fixed-width milling drum (not shown) is located at the same end of the fixed-width milling drum (i.e. the inboard end) thereby allowing the same drive components of the milling machine 10 to be utilized to drive either a fixed-width milling drum or the segmented milling drum 28.

Moreover, such placement of the gear reducing assembly 90 at the inboard end 92 of the milling drum 28 allows the cylindrical outer surface 36 of the milling drum 28 to possess the same outside diameter throughout both the stationary cutting section 30 and the segmented cutting section 32 of the drum. Such a constant outside diameter enhances movement of cut material along the milling drum 28 during operation of the milling machine 10.

INDUSTRIAL APPLICABILITY

In operation, the milling machine 10 may initially be operated to perform a cut of a first width such as two feet. In order to perform a cut having a width of two feet, the segmented milling drum assembly 16 is initially configured so as to include only three end cutter segments 42, as shown in FIG. 4. However, as described above, in order to increase the cutting width of the segmented milling drum assembly 16, a number of the main cutting segments 40 and the end cutting segments 42 may be secured to the milling drum 28 in order to produce a cutting width of either two feet or three feet. In particular, the curved mounting plate 48 of each of the main cutting segments 40 to be installed is positioned in contact with the milling drum 28 such that the curved inner surface 50 of the mounting plate 48 substantially conforms to the cylindrical outer surface 36 of the milling drum 28. Thereafter, the fastening apertures 64 of the mounting plate 48 are aligned with the fastening apertures 62 defined in the cylindrical outer surface 36 of the milling drum 28. Once aligned, the bolts 66 are then threadingly engaged in the fastening apertures 62, 64 so as to secure the main cutting segment 40 to the milling drum 28.

Similarly, the curved mounting plate 58 of each of the end cutting segments 42 to be installed is positioned in contact with the milling drum 28 such that the curved inner surface 60 of the mounting plate 58 substantially conforms to the cylindrical outer surface 36 of the milling drum 28. Thereafter, the fastening apertures 64 of the mounting plate 58 are aligned with the fastening apertures 62 defined in the cylindrical outer surface 36 of the milling drum 28. Once aligned, the bolts 66 are then threadingly engaged in the fastening apertures 62, 64 so as to secure the end cutting segment 42 to the milling drum 28.

Thereafter, the cutting segments 40, 42 are secured to one another and the stationary cutting flight 34. In particular, one of the nut and bolt assemblies 70 is installed in each of the coupling blocks 68 of the stationary cutting flight 34 and the cutting segments 40, 42 so as to secure (1) the stationary cutting flight 34 to an adjacent cutting segment 40, 42, and (2) adjacent cutting segments 40, 42 to one another.

It should be appreciated that the requisite number of main cutting segments 40 and end cutting segments 42 may be installed in the manner described above in order to create the desired cutting width of the segmented milling drum assembly 16. Moreover, it should also be appreciated that any of the fastening apertures 62 defined in the cylindrical outer surface 36 of the milling drum 28 which are not utilized to secure the cutting segments 40, 42 to the milling drum 28 have one of the bolts 66 threaded therein in order to prevent the threads of the fastening aperture 62 from being damaged during operation of the segmented milling drum assembly 16.

Once installed, the cutting teeth 20 associated with the stationary cutting flight 34 and the cutting segments 40, 42 are utilized to mill or otherwise cut worn roadway material such as asphalt or concrete upon rotation of the segmented milling drum assembly 16. The helical design of the cutting flight assembly (i.e. the stationary cutting flight 34 and the flight members 48 associated with the installed cutting segments 40, 42) and the kicker plates 72 advance cut material in the general direction of arrow 22 of FIG. 2 away from the cutting teeth 20 and toward the input of a lower conveyor 24. As described above, the lower conveyor 24 then conveys the cut material into the input of the discharge conveyor 26 in order to facilitate removal thereof from the work site.

If it is later desirable to perform a cut of a narrower width, the bolts 66 may be removed from the fastening apertures 62, 64 and the nut and bolt assemblies 70 removed from the coupling blocks 68 thereby allowing the appropriate cutting segments 40, 42 to be lifted away or otherwise removed from the cylindrical outer surface 36 of the milling drum 28. Thereafter, a bolt 66 is placed in each unused fastening aperture 62 defined in the cylindrical outer surface 36 in order to prevent the threads therein from being damaged during subsequent operation of the segmented milling drum assembly 16.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

For example, the kicker plates 72 may be configured to include a number of extension plates which may be bolted onto the kicker plates 72 when the segmented milling drum assembly 16 is configured to perform a cut having a width of four feet. Such extension plates facilitate advancement of cut material to the input of the lower conveyor 24 by the kicker plates 72.

There are a plurality of advantages of the present invention arising from the various features of the milling machine described herein. It will be noted that alternative embodiments of the milling machine of the present invention may not include all of the features described yet still benefit from at least some of the advantages of such features. Those of ordinary skill in the art may readily devise their own implementations of the milling machine that incorporate one or more of the features of the present invention and fall within the spirit and scope of the present invention as defined by the appended claims.

What is claimed is:

1. A variable-width milling drum assembly, comprising:

a milling drum having an outer surface; and a plurality of cutting segments removably secured to said outer surface of said milling drum along a first substantially helical axis, wherein (i) each of said plurality of cutting segments includes a segment flight member, and (ii) each segment flight member is positioned in helical alignment with respect to an adjacent segment flight member.

2. The variable-width milling drum assembly of claim 1, wherein:

each of said plurality of cutting segments has an outer end and an inner end, said inner end of each of said plurality of cutting segments is secured to said outer surface of said milling drum, and said outer end of each of said plurality of cutting segments has a number of cutting teeth secured thereto for cutting material during rotation of said milling drum.

3. The variable-width milling drum assembly of claim 1, further comprising:

a stationary flight member non-removably secured to said outer surface of said milling drum along said first substantially helical axis, wherein said stationary flight member is in helical alignment with each of said segment flight members of said plurality of cutting segments, whereby cut material is advanced along said stationary flight member and each of said segment flight members of said plurality of cutting segments during rotation of said milling drum.

4. The variable-width milling drum assembly of claim 1, wherein:

said outer surface of said milling drum is substantially cylindrically shaped, each of said flight members of said plurality of cutting segments has a curved mounting plate secured thereto, and said curved mounting plate substantially conforms to said outer surface of said milling drum.

5. The variable-width milling drum assembly of claim 4, further comprising a fastener, wherein:

said curved mounting plate has a first fastening aperture defined therein, said outer surface of said milling drum has a second fastening aperture defined therein, said first fastening aperture is aligned with said second fastening aperture, and said fastener is positioned in both said first fastening aperture and said second fastening aperture.

6. The variable-width milling drum assembly of claim 1, further comprising:

a kicker plate secured to said outer surface of said milling drum, wherein said kicker plate has a first portion which is secured to said outer surface of said milling drum along a second substantially helical axis, whereby cut material is moved across a portion of said milling drum that is devoid of said plurality of cutting segments in a direction parallel to a central axis of rotation of said milling drum by said kicker plate during rotation of said milling drum.

7. The variable-width milling drum of claim 6, wherein said kicker plate further has a second portion which is secured to said outer surface of said milling drum in an orientation which is substantially parallel to a central axis of rotation of said milling drum, whereby said cut material is moved in a direction perpendicular to said central axis of rotation of said milling drum so as to be advanced to an input of a conveyor during rotation of said milling drum.

8. The variable-width milling drum of claim 1, further comprising a fastener, wherein:

said plurality of cutting segments includes a first cutting segment and a second cutting segment, said second cutting segment being positioned on said milling drum adjacent to said first cutting segment, said first cutting segment includes a first coupling block having a first coupling aperture defined therein, said second cutting segment includes a second coupling block having a second coupling aperture defined therein, and said fastener is positioned in both said first coupling aperture and said second coupling aperture so as to secure said first cutting segment to said second cutting segment when both said first cutting segment and said second cutting segment are secured to said outer surface of said milling drum.

9. The variable-width milling drum of claim 8, wherein:

said first cutting segment has a first front face and a first rear face, said second cutting segment has a second front face and a second rear face, said first coupling block is secured to said first rear face of said first cutting segment, and said second coupling block is secured to said second rear face of said second cutting segment, whereby cut material is advanced in a direction parallel to a central axis of rotation of said milling drum along both said first front face of said first cutting segment and said second front face of said second cutting segment during rotation of said milling drum.

10. A method of varying cutting width of a variable-width milling drum assembly, comprising the steps of:

providing a milling drum having an outer surface;

providing a plurality of cutting segments, wherein each of said plurality of cutting segments includes a segment flight member; and securing a first set of said plurality of cutting segments to said outer surface of said milling drum along a first substantially helical axis so as to define a first cutting width, wherein each segment flight member of said first set of said plurality of cutting segments is positioned in helical alignment with respect to an adjacent segment flight member when said first set of said plurality of cutting segments is secured to said outer surface of said milling drum.

11. The method of claim 10, further comprising the step of:

securing a second set of said plurality of cutting segments to said outer surface of said milling drum along said first substantially helical axis so as to define a second cutting width, wherein each segment flight member of said second set of said plurality of cutting segments is positioned in helical alignment with respect to an adjacent segment flight member when said second set of said plurality of cutting segments is secured to said outer surface of said milling drum.

12. The method of claim 10, wherein:

said segment flight member of each of said plurality of cutting segments includes has a curved mounting plate secured thereto, said mounting plate substantially conforms to said outer surface of said milling drum, said first securing step includes the step of positioning said curved mounting plate of each of said first set of said plurality of cutting segments in contact with said outer surface of said milling drum, and said second securing step includes the step of positioning said curved mounting plate of each of said second set of said plurality of cutting segments in contact with said outer surface of said milling drum.

13. The method of claim 12, wherein:

said curved mounting plate of each of said first set of said plurality of cutting segments has a first fastening aperture defined therein, said curved mounting plate of each of said second set of said plurality of cutting segments has a second fastening aperture defined therein, said outer surface of said milling drum has a third fastening aperture and a fourth fastening aperture defined therein, said first securing step further includes the steps of (i) aligning said first fastening aperture with said third fastening aperture, and (ii) positioning a first fastener in both said first fastening aperture and said third fastening aperture, and said second securing step further includes the steps of (i) aligning said second fastening aperture with said fourth fastening aperture, and (ii) positioning a second fastener in both said second fastening aperture and said fourth fastening aperture.

14. The method of claim 10, further comprising the step of securing a first portion of a kicker plate to said outer surface of said milling drum along a second substantially helical axis, whereby cut material is moved across a portion of said milling drum that is devoid of said plurality of cutting segments in a direction parallel to a central axis of rotation of said milling drum by said kicker plate during rotation of said milling drum.

15. The method of claim 14, further comprising the step of securing a second portion of said kicker plate to said outer surface of said milling drum in an orientation which is substantially parallel to a central axis of rotation of said milling drum, whereby said cut material is moved in a direction perpendicular to said central axis of rotation of said milling drum so as to be advanced to an input of a conveyor during rotation of said milling drum.

16. A cutting segment adapted to be secured along a substantially helical axis to an outer surface of a milling drum, said milling drum having a stationary flight member secured to said outer surface thereof, comprising:

a segment flight member having an outer end; and a number of cutting teeth secured to said outer end of said segment flight member, said cutting teeth being configured to cut material during rotation of said milling drum, wherein said segment flight member is configured to be in helical alignment with said stationary flight member when said segment flight member is secured to said milling drum.

17. The cutting segment of claim 16, further comprising a number of tooth holders secured to said outer end of said segment flight member, wherein each of said number of cutting teeth is secured to one of said number of tooth holders.

18. The cutting segment of claim 16, further comprising a curved mounting plate secured to an inner end of said segment flight member, wherein:

said outer surface of said milling drum is substantially cylindrically shaped, and said curved mounting plate is configured to substantially conform to said outer surface of said milling drum when said cutting segment is secured to said milling drum.

19. The cutting segment of claim 18, wherein:

said curved mounting plate has a first fastening aperture defined therein, said outer surface of said milling drum has a second fastening aperture defined therein, and said curved mounting plate is configured such that said first fastening aperture aligns with said second fastening aperture when said cutting segment is secured to said outer surface of said milling drum.

20. A variable-width milling drum assembly, comprising:

a milling drum having an outer surface;

a number of cutting segments removably secured to said outer surface of said milling drum; and a kicker plate secured to said outer surface of said milling drum, said kicker plate having a first portion which is angled relative to a central axis of rotation of said milling drum, whereby cut material is moved across a portion of said milling drum that is devoid of said number of cutting segments in a direction parallel to a central axis of rotation of said milling drum by said first portion of said kicker plate during rotation of said milling drum.

21. The variable-width milling drum assembly of claim 20, wherein said first portion of said kicker plate is secured to said outer surface of said milling drum along a substantially helical axis.

22. The variable-width milling drum assembly of claim 20, wherein said kicker plate further has a second portion which is secured to said outer surface of said milling drum in an orientation which is substantially parallel to said central axis of rotation of said milling drum, whereby said cut material is moved in a direction perpendicular to said central axis of rotation of said milling drum so as to be advanced to an input of a conveyor during rotation of said milling drum.

23. A variable-width milling drum assembly, comprising:

a milling drum having a substantially cylindrical outer surface; and a plurality of cutting segments removably secured to said milling drum along a first substantially helical axis, wherein (i) each of said plurality of cutting segments is in helical alignment with respect to adjacent cutting segments and has a curved outer end and a curved inner end, (ii) said curved inner end is configured to substantially conform to said substantially cylindrical outer surface of said milling drum when each of said plurality of cutting segments is secured to said milling drum, and (iii) said curved outer end has a number of cutting teeth secured thereto for cutting material during rotation of said milling drum.

24. The variable-width milling drum assembly of claim 23, wherein:

each of said plurality of cutting segments includes a flight member having a curved mounting plate secured thereto, and said curved mounting plate defines said curved inner end of each of said plurality of cutting segments.

25. The variable-width milling drum assembly of claim 24, further comprising a fastener, wherein:

said curved mounting plate has a first fastening aperture defined therein, said substantially cylindrical outer surface of said milling drum has a second fastening aperture defined therein, said first fastening aperture is aligned with said second fastening aperture, and said fastener is positioned in both said first fastening aperture and said second fastening aperture.

26. The variable-width milling drum assembly of claim 23, further comprising a kicker plate secured to said substantially cylindrical outer surface of said milling drum, said kicker plate having a first portion which is secured to said substantially cylindrical outer surface of said milling drum along a second substantially helical axis.

27. The variable-width milling drum of claim 26, wherein said kicker plate further has a second portion which is secured to said substantially cylindrical outer surface of said milling drum in an orientation which is substantially parallel to a central axis of rotation of said milling drum.

* * * * *